United States Patent [19]

Young, Jr. et al.

[11] 4,068,789

[45] Jan. 17, 1978

[54] METHOD AND APPARATUS FOR CONTROLLING A MOVING WEB

[75] Inventors: William O. Young, Jr., Spartanburg; Mansel A. Jennings, Inman, both of S.C.

[73] Assignee: Young Engineering, Inc., Spartanburg, S.C.

[21] Appl. No.: 625,756

[22] Filed: Oct. 24, 1975

[51] Int. Cl.[2] ..... B65H 23/02

[52] U.S. Cl. ..... 226/3; 26/51.5; 26/105; 198/840; 226/15; 226/17

[58] Field of Search ..... 226/3, 15, 17, 21, 16, 226/22, 118; 26/99, 105, 98, 51.5; 198/202, 840; 271/227, 251; 74/241; 38/143

[56] References Cited

U.S. PATENT DOCUMENTS

| | | | |
|---|---|---|---|
| 739,781 | 9/1903 | Green | 26/105 X |
| 1,005,801 | 10/1911 | Birch | 26/99 |
| 1,678,925 | 7/1928 | Tackaberry | 226/15 |
| 1,769,687 | 7/1930 | Hamilton | 226/17 |
| 3,727,820 | 4/1973 | Braun | 226/118 X |
| 3,774,271 | 11/1973 | Depuy et al. | 226/15 X |

OTHER PUBLICATIONS

Sorsen S. L., "17 Ways to Track the Edge", Control Engineering, May 1964, pp. 77–80.

*Primary Examiner*—Bruce H. Stoner, Jr.
*Attorney, Agent, or Firm*—Wellington M. Manning, Jr.; Luke J. Wilburn, Jr.

[57] ABSTRACT

Apparatus is disclosed for controlling the position of a moving web. The web passes between a driven roll and a pair of pressure applicators that are positioned on either side of center of the web path. Edge sensors are located adjacent the driven roll and are operatively connected with the pressure applicators. Once the web misalignment is sensed, the opposite pressure applicator is actuated to apply pressure against the web. The driven roll, preferably a scroll roll, then drives the web in the direction of the pressure applicator until the web returns to proper alignment and the pressure applicator is deactuated. The pressure applicator is preferably a device that is brought into contact with the web and applies frictional forces thereon to cause movement of the web along the roll, while avoiding any substantial frictional forces axially with respect to the normal web path. Structure is also disclosed to uncurl rolled selvages of a moving web. A method of controlling lateral position of a moving web is also disclosed and claimed herein.

17 Claims, 7 Drawing Figures

METHOD AND APPARATUS FOR CONTROLLING A MOVING WEB

BACKGROUND OF THE INVENTION

In the movement of an intermediate length of a web material such as might be found in the textile industry, the web oftentimes passes through a plurality of separate or related operations in an overall process. In each of these operations it is desirable and sometimes essential that the web be in a particular position with respect to the apparatus to ensure proper processing of the web without causing damage to the web or producing "off quality" goods. Since, as a general rule, the apparatus handling the web is substantially wider than the width of the web, lateral movement of the web across the apparatus is probable. Such lateral movement can create improper web alignment with respect to the particular equipment. Proper web alignment is particularly important in those processes where the web needs to be brought into registry to permit a normal process function. For example, in laminating, printing, tentering, and similar operations, a web must first be properly aligned prior to commencing of the process. Likewise, through not necessarily essential, good web alignment is greatly preferred for batching, coating, and virtually all web handling processes. Movement of the web out of the anticipated path of web travel may subject the web to unused and soiled parts of the web handling equipment.

Certain webs also tend to curl or roll up along the edges during handling. During winding of a web with a curled edge, an unsightly and technically poor package will be produced. In those operations where the attitude of the web is critical, such as bonding, printing and the like, it is essential that any curl, creases, folds and the like be removed. Uncurling devices are then often needed to remove curl from the selvages of the web. Numerous uncurling devices have been developed heretofore, the majority of which have some attendant disadvantages.

Several techniques have heretofore been developed to control the lateral position of a moving web. Each of these techniques employs a device to detect the position of the web and to actuate a correctional means responsive thereto. Oftentimes these detectors include a beam of light that is directed across a predetermined area with a photo receiver being positioned on the opposite side of the web path. Once the web breaks the beam of light, or permits the light to be received by the photo conductor, as the system dictates, certain means are actuated to signal that the web is out of proper alignment. The web can then be manually or automatically adjusted to its proper path of travel to provide for further proper processing thereof.

The present invention represents an improvement in the art of such devices as will be described in complete detail hereinafter. There is no known prior art that would anticipate or suggest the method or apparatus of the present invention.

SUMMARY OF THE INVENTION

It is an object of the present invention to provide novel apparatus for controlling a moving web.

Another object of the present invention is to provide apparatus for controlling the lateral position of a moving web.

Still another object of the present invention is to provide apparatus for controlling the flatness of a moving web.

A further object of the present invention is to provide a method for controlling the lateral position of a moving web.

Yet another object of the present invention is to provide apparatus for detecting a fabric edge, properly aligning the lateral position of the fabric in response thereto and insuring that the web is in a flat, uncurled condition.

Generally speaking, the apparatus of the present invention is directed to controlling a moving web and comprises a driven roll in contact with a web moveable thereacross, said roll having means associated therewith to drive said web laterally under predetermined pressure conditions only; means to selectively apply pressure between said driven roll and said web on one edge of said web only, whereby said roll drives said web in the direction of increased pressure, and web detector means operatively associated with said pressure means to selectively actuate and deactuate said pressure means responsive to position of said web.

More specifically, the control system of the present invention preferably includes a scroll roll which is a roll having one helical element extending therealong, or having two helical elements wound in opposite directions, emanating from a medial portion thereof and extending outwardly toward opposite ends thereof. The point where the helices change direction may be centrally located along the roll or offset as desired. Preferably, a roll is employed where two oppositely pitched leads permit a fabric or other type web to pass along in contact with the roll with a transverse force extending from the portion of the roll where the leads originate outwardly in both directions, whereby a net transverse force of zero being realized when the web is centered over same. The web thus axially moves along its intended path across the roll. When, however, an additional force is applied to the web along one edge of same, a pressure imbalance is created on the side of the roll. The helical winds on the increased pressure side of the driven roll then cause the web to undergo a screw type action, whereby the web is moved laterally, in the direction of the pressure.

Apparatus of the present invention preferably includes pressure applicator means, one being provided on each side of the fabric path, and located above the web. In conjunction with the pressure applicator means, web detector means are also associated therewith to monitor the position of the web during movement. Upon sensing a deviation of the transverse position of the web, the detector means signals the pressure applicator means on the side of the web to which the web should move to bring same back into a proper position. Once the web is back in proper position, the pressure means is deactuated and the web moves normally along its intended path. Also an interrupter means is provided for each of the pressure applicator means, the purpose of which will be described hereinafter.

A key element of the present invention is the particular type pressure applicator means that is employed. For example, a device may be employed which makes contact with the top of the web. Pressure is thus applied through the web and against the scroll roll to enable the scroll roll to move the web in the desired direction. Force should be applied in the web without producing excessive frictional forces in the axial direction with respect to the web path. A bird cage type device has been utilized, for example, having a plurality of rods in circular arrangement which, when brought into contact with the web will roll along the scroll roll applying the needed pressure. Conical brushes in angular disposition with respect to the axial direction of web movement will roll without causing undue axial frictional forces on the web. Other pressure applicator devices will also be equally suitable and are intended to be within the scope of the present invention. In fact, suitable air pressure arrangements may be employed where air is directed against the web to produce the pressure for movement by the scroll roll.

Since many webs have a tendency to curl inwardly from an outer edge, an edge uncurler unit may form a part of the present invention. A pair of banks of opposed, parallel members may be disposed at an angle with respect to the direction of movement of the web with the web passing therebetween. As the web selvage passes between the opposed elements, the curl therein is removed. Further, placement of the uncurler device immediately prior to a take up for the web or a nip will prevent return of the curl into the web after passing through the device.

Web sensors that are used to monitor the position of the web are normally positioned adjacent an edge of the web, though for certain operations, center guiding of the web is preferred. Suitable sensors include photocells, air, low force mechanical, and the like.

The method of controlling according to the present invention generally comprises the steps of feeding a web across a driven roll, said roll having means thereon to move the web in a direction transverse to the normal direction of movement upon receipt of a pressure thereon, detecting the transverse position of the moving web M and actuating pressure applicator means upon detecting a transverse movement of the web out of its designed axial path, whereby the pressure applicator means on the side of the web in the direction of the desired movement applies pressure against the web which, in turn, causes the driven roll to move same in the desired direction until a sensing means detects proper alignment, whereupon the pressure means is deactuated.

More particularly, once a moving web drifts out of proper alignment, is forced out of alignment or the like, an edge guide or other type sensor detects the misalignment. The particular sensing element then actuates a pressure means on an opposite side of the web. The actuated pressure means produces the necessary pressure imbalance whereby the driven roll moves the web transversely in the direction of pressure imbalance until the sensors determine that the web has returned to a proper position and deactuates the pressure means.

DESCRIPTION OF THE PREFERRED EMBODIMENTS

Figure 1:
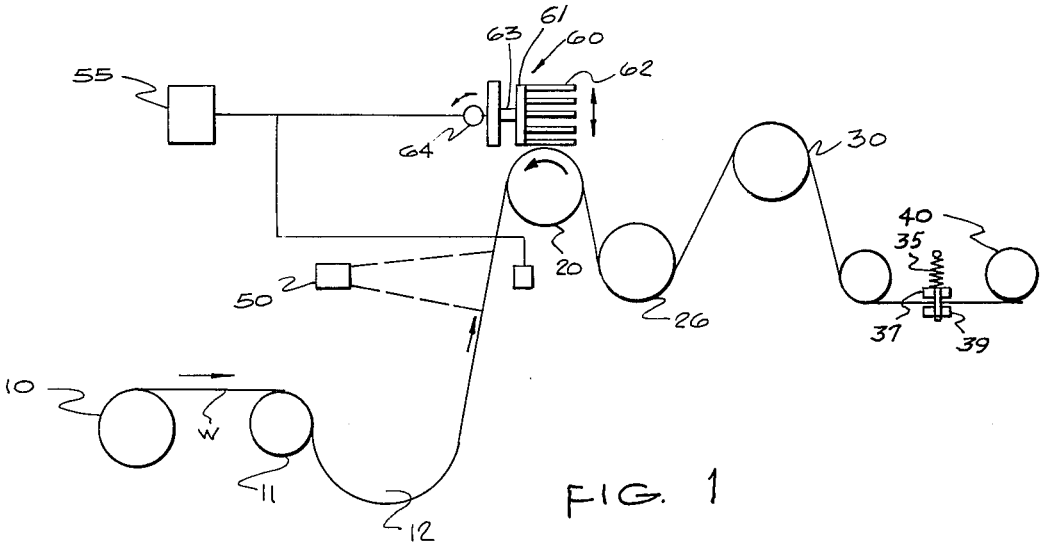
FIG. 1 is a schematic of web control apparatus according to the teachings of the present invention.

Referring to the Figures, preferred embodiments of the present invention will be described in detail. In FIG. 1, a schematic of the basic method and apparatus of the present invention is illustrated. In FIG. 1, a roll or other source of supply 10 of a web material W is provided for feeding the web W through a particular batching process or some other process as desired. The process illustrated is no more than a winding or batching of web 10 onto a take-up roll 40. Intermediate elements are provided to ensure proper web alignment, to uncurl the selvages of the web and to generally provide a tight and uniform web roll. Obviously, other types of equipment may be utilized subsequent to feed means 10. In this context, the control system of the present invention is not designed for any particular type machine, but is designed for compatibility with any system or process where an intermediate length of material is fed along a process path, and where transverse position of the web is an important variable.

Figure 2:
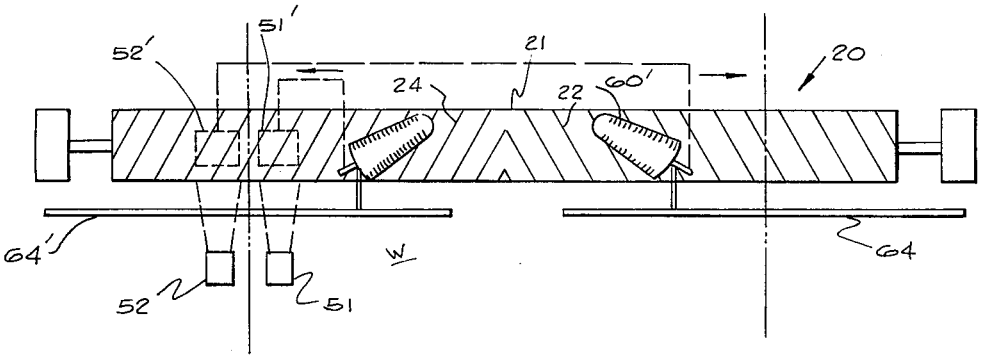
FIG. 2 is a plan view of a portion of the control apparatus according to the teachings of the present invention.
Figure 7:
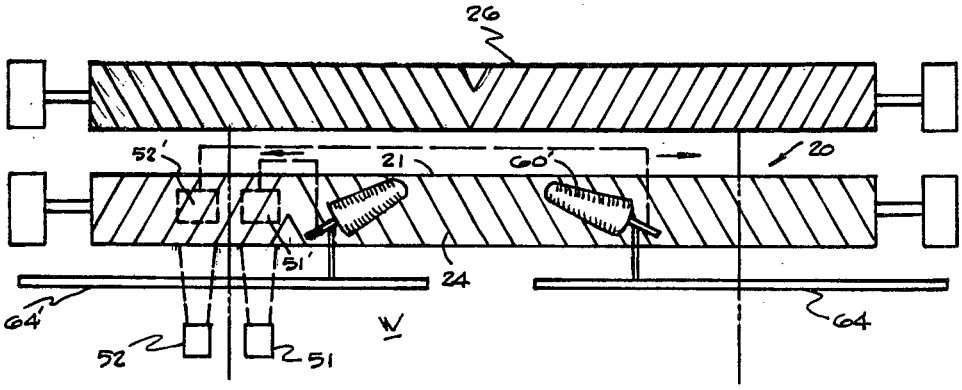
FIG. 7 is a top view of the present invention.

In FIG. 1, web W leaves the feed means 10 and passes over a spreader bar system 11 which ensures that web 10 is at an open width. Web W then passes through an accumulator stage 12 which may be a scray or the like. Accumulator 12 permits proper web handling during thread-up and tie in of a new roll or supply of web 10. Web W then passes upwardly over a driven roll 20 which is a scroll roll or the like. Preferably scroll roll 20 is driven in a direction opposite the direction of the web movement as indicated by the arrow. As shown in FIG. 2, helical elements 22 and 24 with opposite pitch start at a medial portion of the roll 20 and extend outwardly therefrom. Driven scroll roll 20 may have only a single helical lead therealong instead of two oppositely pitched leads. Likewise, where opposite pitch leads are employed, it is not necessary for them to originate at the center of the roll, and they may be offset from the center. The weight of the web W cooperating with the helices 22 and 24 of scroll roll 20 will cause a transverse movement of web W. Since the helices are of opposite pitch, the net transverse force is substantially zero where the helices originate at the center of the roll, whereby the web merely moves across the helices along its intended path. A scroll roll in an unbalanced condition where the oppositely pitched leads meet at an off center location, will drive the web in the direction of the longest lead (FIG. 7). Almost constant corrective action will offset the drive and permit axial movement of the web over the roll. As web W moves axially across scroll roll 20, along its intended path of travel, numerous variances in the process can cause a simultaneous transverse movement of the web W along roll 20. This transverse movement, as mentioned above, creates difficulty in the handling of the web, for subsequent feed to a print machine or the like or in producing a precision wound roll at take-up means 40. It is thus generally conventional in web handling processes to employ an edge, center or other means as generally exemplified by the detector means 50 of FIG. 1, in conjunction with some means to correct the lateral position of web W when misalignment is determined by the detector means.

Numerous types of detector means are available for use in controlling a textile web. Elements are available through which an edge of the material passes and which, upon physical contact, the absence of the web, pressure conditions or the like, senses the position of the web and thereafter signals a predetermined correction therefor. A further type of detector means is a photoelectric system in which a light beam is directed across an area where, depending upon the particular system employed, the web should be present or absent. A photo receiver is located on the opposite side of the web path which, again depending upon the system design, will signal misalignment of the web due to breaking of the beam or due to receipt of the beam by the receiver. Still further, center guiding may be employed whereby the edge sensors are mounted on a screw with the sensors being located at opposite edges of the web path. Upon sensing a misalignment, the second sensor signals a necessary right or left movement of the first sensor along the screw. The first sensor continues to control the pressure applicator means to properly position the lateral position of the web. In any sense, however, the detectors are designed to sense movement of web W in a transverse direction, out of proper alignment, and thereafter signal an appropriate correction therefor.

According to the teachings of the present invention, once a deviation from the normal path is sensed, a pressure applicator means is actuated on the side of the web in which corrective movement is needed. Upon actuation, the pressure applicator means applies an appropriate pressure against web W which is transmitted to driven scroll roll 20, creating a pressure imbalance between web W and roll 20. The increased pressure on one side of the central area 21 of roll 20 permits that particular helix to move web W toward the respective end of roll 20. In using a scroll roll with imbalance in the helices, a constant driving forces may be experienced in the direction of the long helix. As such, an almost constant corrective pressure force is needed in the opposite direction to maintain the web in a proper location. Any corrective movement continues until the detector means senses that the web is again realigned whereupon the particular pressure applicator means is deactuated and the web continues to move along its intended path, unobstructed. In a preferred embodiment, means are employed to permit only intermittent actuation of the pressure means. Hence, a slack web edge will not bunch up, but will pass across roll 20 with little or no difficulty.

Figure 4:
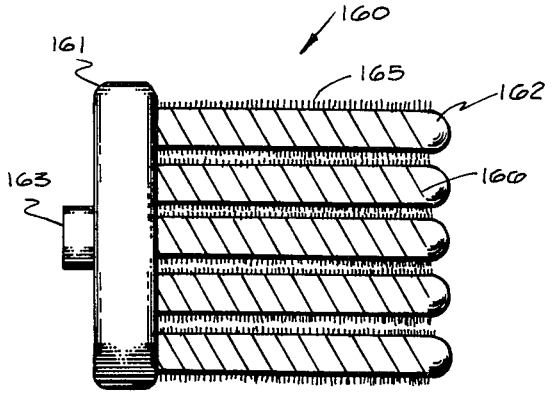
FIG. 4 is a side view of a further embodiment of a pressure applicator means according to the present invention.
Figure 5:
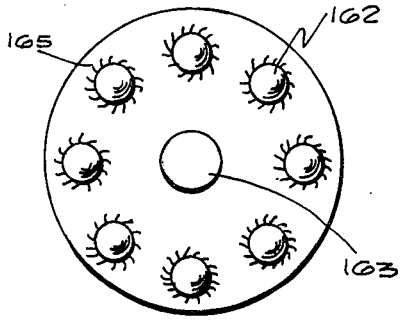
FIG. 5 is an end view of the pressure applicator means as shown in FIG. 4.

As shown in FIG. 1, a pressure applicator means 60 is used that is similar in construction to that illustrated in FIGS. 4 and 5. The differences will be pointed out hereinafter. The particular pressure applicator means 60 illustrated in FIG. 1 comprises a plate 61 with a plurality of fingers 62 provided in circular fashion therearound and extending outwardly therefrom. Plate 61 and fingers 62 are rotatably received on a shaft 63 which, in turn, is associated with an actuator rod 64 to be positioned above roll 20. Upon receipt of a proper signal from the detector means 50, the control unit 55 actuates pressure applicator means 60 on one side of the roll 20. Appropriate shaft 64 or 64' is partially rotated whereby the appropriate pressure applicator means associated therewith moves downwardly toward roll 20. Means 60 thus engages web W and applies the appropriate pressure against that particular side of roll 20 permitting web W to be driven in the appropriate direction. Thereafter, once the required corrective movement of web W has been realized, deactuation of pressure applicator means 60 causes a return pivotal movement of means 60 and its appropriate rod 64 or 64' upwardly, away from web W.

In certain embodiments of the present invention, a second driven scroll roll 26 may be provided downstream of first driven scroll roll 20 with the helical elements of same being oppositely pitched from scroll roll 20 (FIG. 7). In this fashion, a transverse, spreading force is applied to opposite sides of the web W to assist in flattening curl that might occur along selvages of the web. Thereafter, web W passes over suitable guide rolls 30 and onto an appropriate processing station, take-up 40 or the like. Once web W is in a proper lateral position and curl has been at least partially removed from the selvage, tension may be detrimental to both web position and curling. A preferred arrangement thus includes a tension roll 30 which may be located along the web path downstream from scroll rolls 20 and 26. In a most preferred arrangement, first scroll roll 20 is driven in a direction opposite the direction of web travel while second scroll roll 26 is driven in the same direction of web travel. Second scroll roll 26 can thus be driven at a slightly faster speed than web travel to maintain web W at approximately tensionless conditions. A further preferred component of the apparatus of the present invention is an edge uncurler means 35 that may be received immediately at the take-up roll 40 or immediately prior to a web nip adjacent further processing equipment (not shown). Accurate position in either arrangement permits the web to be maintained in the flat, uncurled state after leaving the uncurler means 35. Decurler means 35 generally comprises a pair of banks of upper and lower elongated elements 37 and 39, respectively, that are separated and permit passage of web W therebetween. Engagement between web W and the corresponding decurler elements removes any curl from the selvage of web W.

Figure 3:
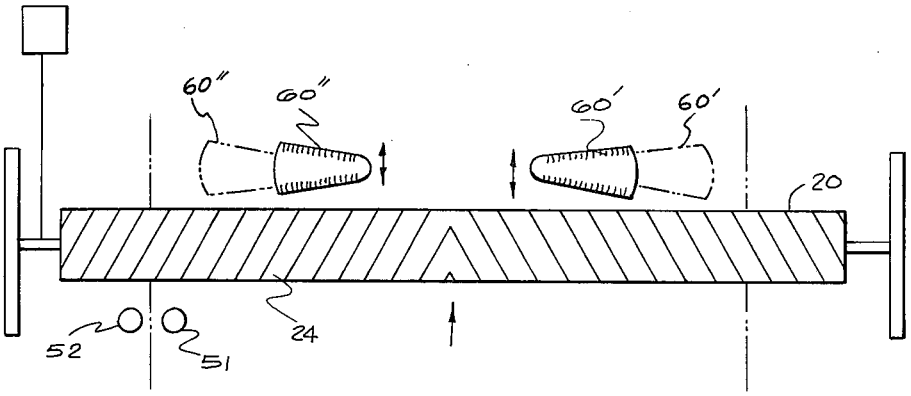
FIG. 3 is an elevational view of the apparatus of FIG. 2.

Pressure applicator elements according to the present invention should apply appropriate pressure against web W without creating any substantial frictional forces in the axial direction with respect to movement of web W. Note that the bird cage like element 60 as shown in FIG. 1 is rotatable. Once the bird cage is brought into contact with the web W, the appropriate helix 22 or 24 coacts with the fingers 62 of bird cage 60 to cause a rotary motion of same. Very little axial frictional force is produced on web W due to rotation of element 60, and the small area contact with fingers 62. In FIGS. 2 and 3, conical brushes 60' and 60'' are illustrated in a further embodiment of a pressure applicator means. The conical brushes are angularly disposed such that once they are moved downwardly by rotation of the appropriate shaft 64 or 64' into contact with web W, a rolling movement is imparted to the brush. Sufficient pressure is created against web W to cause transverse movement of same while at the same time avoiding production of any substantial axial frictional forces. While separate shaft 64 and 64' are illustrated, a single shaft may be employed with separate means for pivotal movement of the particular pressure applicator means. A plurality of pressure applicator elements may be employed on each side of web W as illustrated in phantom in FIG. 3, whereby lesser pressure may be employed with each element.

A further embodiment of the pressure applicator means is illustrated in FIGS. 4 and 5 where a pressure element 160 very similar to the bird cage 60 of FIG. 1 is illustrated. In FIGS. 4 and 5, a plate 161 is secured for rotation around a shaft 163 and has a plurality of fingers 162 extending in a circular arrangement therearound and extending outwardly therefrom. Pressure applicator means 160 differs from that of FIG. 1, in that, the finger elements 162 have bristles 165 or the like secured therearound. Bristles 165 are preferably arranged in a helical pattern around fingers 162 to afford the sufficient pressure for transverse correctional movement of web W without any substantial axial friction. In addition to the three types of pressure applicator elements illustrated, obviously others are available. Any means may be utilized so long as it may be individually applied to either side of web W to create pressure necessary to create transverse movement of web W without the application of the axial forces thereon with respect to the web path.

Figure 6:
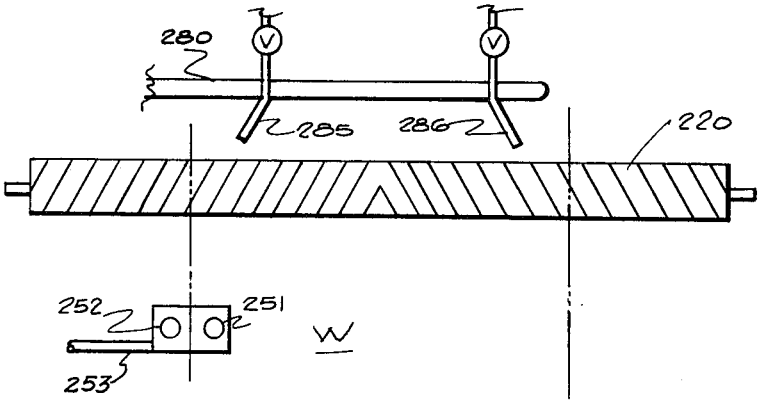
FIG. 6 is an elevational view of a further embodiment of the present invention.

FIG. 6, for example, illustrates a scroll roll 220 having detector elements 251 and 252 located along the path of a web W thereacross. An air header 280 is located above roll 220 and has an air jet 285 and 286 on each side of the path of web W. Each of the jets 285 and 286 is operatively associated through appropriate valving with its respective detector such that when a deviation of transverse position of web W is noted, the appropriate air jet, 285 and 286 is actuated to issue a stream of air against web W and create a pressure imbalance to cause scroll roll 220 to move web W in the transverse direction.

The web detector system illustrated in FIG. 6 shows two air sources 251 and 252 connected to an air header 253 with respective receivers (not shown) positioned on an opposite side of the web path. As illustrated, the two units are located close together with a small correct path edge positioned between the two. Practically speaking, the web does not remain between the two air detectors, but moves about such that there are frequent adjustments of small magnitude to web position. Preferably, the two detector units are positioned downstream of the first scroll roll 220 and are shown along the same edge of web W. One unit could also be positioned along each edge of the path if desired. Moreover, it is also possible to use only a single detector unit, though such an arrangement is not preferred. In any event, movement of web W away from air detector 251 permits an air stream to be received by the air receiver therefor and to actuate pressure applicator means 285 to cause web W to be moved to the left. Conversely, an interruption of the air stream from unit 252 to its receiver will cause an opposite movement of web W.

In operation, making reference to FIG. 1 in particular, a web W is withdrawn from a supply source 10, is opened by spreader 11 and passes through scray 12 to driven scroll roll 20. The detector element 50 senses the lateral position of web W and so long as web W passes along its intended path, pressure applicator means 60 remains deactuated and web W merely passes across scroll roll 20. If, however, referring to FIGS. 1, 2 and 3, one of the detectors 51 or 52 senses a lateral misalignment of web W, then it is necessary to return web W to its normal path of travel. To accomplish this result, the appropriate pressure applicator means 60 (a conical brush as illustrated in FIG. 3) is actuated and is moved downwardly into contact with web W creating a pressure imbalance and causing one of the helices of scroll roll 20 to move web W in the appropriate direction. As illustrated in FIGS. 2 and 3, optical receiver 52' will sense the web as out of line to the left. The right pressure applicator 60' is thus actuated to cause corrective web movement to the right. Conversely, optical receiver 51' senses web misalignment to the right and actuates pressure applicator 60'' to create corrective web movement to the left.

Once web W is back within the confines of its normal path of travel, the pressure applicator is deactuated whereby it returns to its normal position above web W and web W proceeds again unimpeded across scroll roll 20. Numerous pressure applicator elements have been illustrated herein. It has been determined that different webs are better suited to different types of pressure applicator elements. For example, in textile webs, a spun fiber that is woven into a fabric will function better with one pressure applicator element than a filament yarn that has been extruded and thereafter woven into a fabric, knitted or the like. Basic differences appear to relate to the elements that go into the make-up of the fabric and the individual frictional characteristics of same, the weight of the fabric, the construction of the fabric and the way in which the fabric is manufactured. In any event, however, all of these things may be taken into consideration so as to design an optinum system for practice of the present invention. Moreover, materials other than textile fabrics have likewise been handled according to the present invention.

In general, operation of the present invention involves a large number of small changes instead of a few large changes. Hence, pressure applicator elements are frequently actuated for short periods of time. Electronics for the operative connection of detectors and pressure applicators is conventional and need not be discussed herein. Suffice it to say that a detector upon sensing web misalignment, brings about actuation of the proper pressure applicator element.

Downstream from the web alignment means, other operation may be performed on web W. For instance, a second scroll roll may be included with opposite helix pitch which causes an opposite spreading motion to web W to treat an opposite side thereof. Likewise, adjustable tension means may be included to hold web W under very slight tension to hold same flat. Web W may further be treated by an edge uncurler to remove any curl that exists along the web selvage.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. Apparatus for controlling lateral position of a moving textile web comprising:

a. a driven roll extending across a path of travel of said moving textile web, said roll means having at least one helical element thereon to move said textile web in a lateral direction under predetermined conditions;

b. pressure applicator means located adjacent said driven roll and being actuatable under predetermined conditions to make contact with said web on said roll and cooperate with said roll to drive said web in a lateral direction while avoiding imparting any substantial axial forces on said web with respect to the direction of web travel; and c. web detector means located along said path of travel for detecting lateral position of said web, said detector means being operatively associated with said pressure applicator means to actuate and deactuate same responsive to the lateral position of said web.

2. Apparatus for controlling lateral position of a moving web as defined in claim 1 wherein two helical elements are secured to said roll, said elements originating at a point intermediate the length of said roll and extending outwardly in opposite direction therefrom.

3. Apparatus for controlling lateral position of a moving web as defined in claim 2 wherein said elements originate at a point along said roll that is offset from the center of said roll length.

4. Apparatus for controlling the lateral position of a moving web as defined in claim 1 wherein said pressure applicator means comprise brush means positioned above said roll, said brush means being actuatable to move downwardly into contact with said web.

5. Apparatus for controlling lateral position of a moving web as defined in claim 4 wherein two conical brushes are employed and are disposed at an angle which minimizes any axial friction forces on said web when said brushes are in contact with said web.

6. Apparatus for controlling lateral position of a moving web as defined in claim 1 wherein said web detector means comprises at least one photoelectric optical detector arranged adjacent an edge of the web path.

7. Apparatus for controlling lateral position of a moving web as defined in claim 6 wherein two detectors are utilized, each including a light source and a photocell, said detectors being located along one edge of said web path and having a small space between same.

8. Apparatus for controlling lateral position of a moving web as defined in claim 1 wherein said pressure applicator means comprises a device having a plurality of finger elements disposed in a circular arrangement whereby said arrangement rotates about its own axis when in contact with said moving web.

9. Apparatus for controlling lateral position of a moving web as defined in claim 8 wherein said fingers have bristles secured thereto in helical rows therearound.

10. Apparatus for controlling lateral position of a moving web as defined in claim 1 wherein said web detector means are air sensors.

11. Apparatus for controlling lateral position of a moving web as defined in claim 1 further comprising:

d. a second driven roll across the path of travel of said web, said second roll having at least one helical element thereon, said at least one helical element having a pitch opposite that of said at least one helical element on said other driven roll.

12. Apparatus for controlling lateral position of a moving textile web comprising:

a. a driven roll across a path of travel of said moving textile web and being supportive of same, said roll being driven in a direction of rotation opposite the direction of web travel and having at least one helical element thereon to move said web in a lateral direction under predetermined conditions;

b. pressure applicator means located adjacent said driven roll and at least along a medial portion of said path of travel thereat, said pressure applicator means being actuatable to make contact with said web on said roll and cooperate with said roll to drive said web in a lateral direction while avoiding any substantial axial forces on said web with respect to the direction of web travel; and c. web detector means located along said path of web travel for detecting lateral position of said web, said detector means being operatively associated with said pressure applicator means to actuate and deactuate same responsive to the lateral position of said web.

13. Apparatus for controlling lateral position of a moving web as defined in claim 12 further comprising:

d. a second driven roll across the path of travel of said web, said second roll having at least one helical element thereon, said at least one helical element having a pitch opposite that of said at least one helical element on said other driven roll.

14. A method of controlling the lateral position of a moving textile web comprising the steps of:

a. feeding a textile web over a driven roll, in engagement across the width of said textile web with at least one helical element thereon;

b. sensing the lateral position of the web;

c. applying pressure on said web at said roll upon sensing a lateral misalignment of same, said pressure being applied on said web at a lateral location of same opposite the lateral misalignment in an amount insufficient to create any substantial axial force on said web with respect to the direction of web travel, whereby said web is driven laterally towards the location of applied pressure so long as said pressure continues; and d. releasing said pressure when said web is sensed as being back in proper lateral alignment.

15. The method as defined in claim 14 wherein sensing of the lateral position of said web is optical.

16. The method as defined in claim 14 wherein said driven roll is driven in a direction opposite the direction of web travel.

17. A method as defined in claim 14 wherein pressure is applied by bringing a rotatable element into contact with said web, said rotatable element being presented at an angle with respect to said roll and rotating about its own axis during contact with said web.

* * * * *